US006012991A

United States Patent [19]

Kim et al.

[11] Patent Number: 6,012,991

[45] Date of Patent: Jan. 11, 2000

[54] GOLF BALL WITH IMPROVED INTERMEDIATE LAYER

[75] Inventors: Hyun Kim, Vista; Dean Snell, Oceanside; Benoit Vincent, Leucadia, all of Calif.

[73] Assignee: Taylor Made Golf Company, Inc., Carlsbad, Calif.

[21] Appl. No.: 09/096,327

[22] Filed: Jun. 12, 1998

[51] Int. Cl.[7] ..... A63B 37/06

[52] U.S. Cl. ..... 473/374; 473/377

[58] Field of Search ..... 473/373, 374, 473/376, 377

[56] References Cited

U.S. PATENT DOCUMENTS

| | | | |
|---|---|---|---|
| 4,473,229 | 9/1984 | Kloppenburg et al. | 273/225 |
| 4,863,167 | 9/1989 | Matsuki et al. | 473/374 X |
| 5,253,871 | 10/1993 | Vrollaz | 473/374 |
| 5,725,442 | 3/1998 | Higuchi et al. | 473/376 |
| 5,733,974 | 3/1998 | Yamada et al. | 473/373 X |

FOREIGN PATENT DOCUMENTS

| | | |
|---|---|---|
| 207425 | 8/1956 | Australia . |
| 2278609 | 12/1994 | United Kingdom . |

OTHER PUBLICATIONS

Derwent Abstract for Japanese Patent Publication No. 62–064378 (Sumitomo Rubber Ind., Ltd.), published on Mar. 20, 1987.

Derwent Abstract for Japanese Patent Publication No. 63–009461 (Sumitomo Rubber Ind., Ltd.), published on Jan. 16, 1988.

Derwent Abstract for Japanese Patent Publication No. 1–223980 (Sumitomo Rubber Ind., Ltd.), published on Sep. 7, 1989.

*Primary Examiner*—George J. Marlo

*Attorney, Agent, or Firm*—Greenblum & Bernstein P.L.C.

[57] ABSTRACT

A golf ball including an improved mantle composition which results in improved performance characteristics. The composition includes a soft, flexible resin, such as an elastomer, and a quantity of at least one hardness-enhancing material, such as a quantity of fibers or fiber segments, such as glass, carbon, aramid, and/or metallic fibers, and, optionally, at least one ionomer. The hardness-enhancing material can constitute about 1 to about 30 wt % of the intermediate layer. The composition of the intermediate layer enables the golf ball to maintain initial speed and distance of known golf balls, while improving upon spin rate and playability. Alternatively, spin rate and playability can be maintained, while improving upon the initial speed and distance.

34 Claims, 1 Drawing Sheet

EXAMPLES:

Intermediate Layer Resin
Hardness ≈ ≤ 25 Shore D, and
Intermediate Layer
Hardness ≈ 63.6 - ≈ 73.5 Shore C Intermediate Layer Resin
Hardness ≈ ≤ 35 Shore D, and
Intermediate Layer
Hardness ≈ 70.8 - ≈ 75.1 Shore C Intermediate Layer Fiber Length
≈ 1/8 inch, ≈ ≥ 100 x diameter

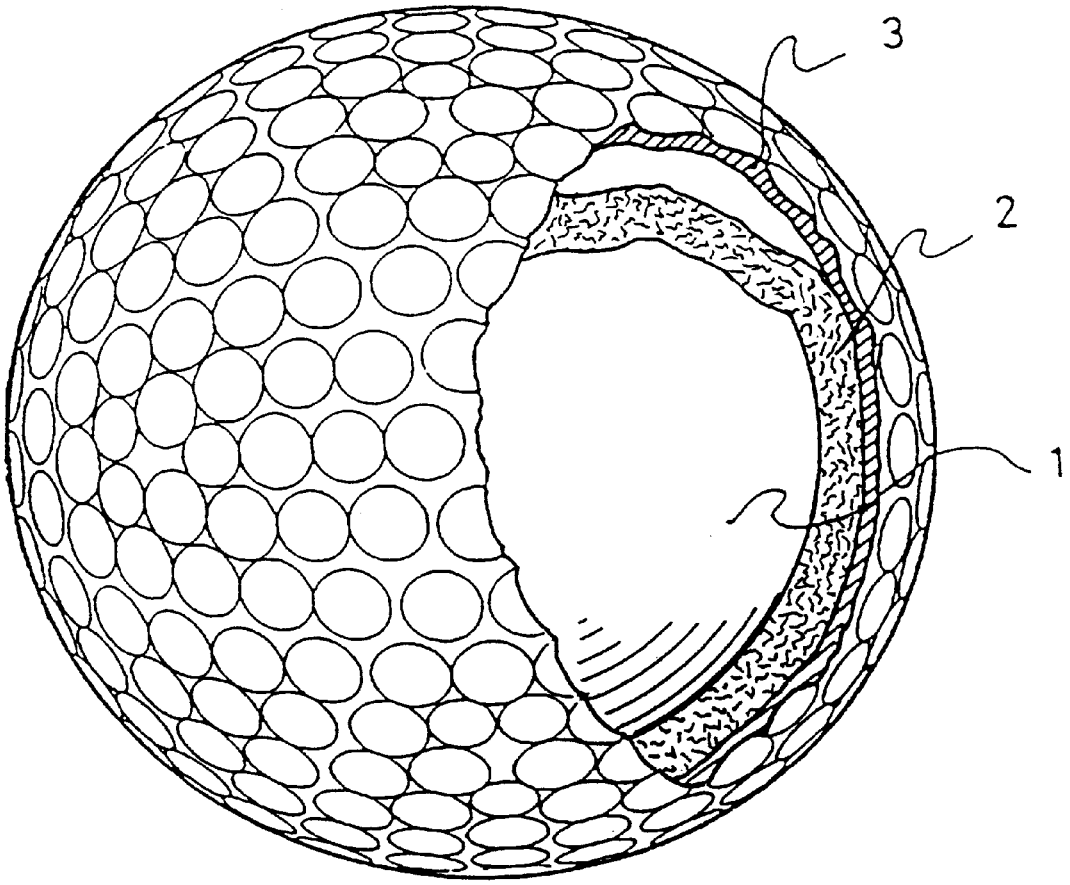
EXAMPLES:
Intermediate Layer Resin
Hardness ≈ ≤ 25 Shore D, and
Intermediate Layer
Hardness ≈ 63.6 - ≈ 73.5 Shore C
Intermediate Layer Resin
Hardness ≈ ≤ 35 Shore D, and
Intermediate Layer
Hardness ≈ 70.8 - ≈ 75.1 Shore C
Intermediate Layer Fiber Length
≈ 1/8 inch, ≈ ≥ 100 x diameter

GOLF BALL WITH IMPROVED INTERMEDIATE LAYER

BACKGROUND OF THE INVENTION

1. Field of the Invention

The present invention relates generally to golf balls, including their structures and compositions. More particularly, the present invention relates to multi-layer golf balls having particular compositions, particularly compositions suitable for use for the mantle or intermediate layer of a golf ball, i.e., a layer positioned between the cover and the innermost core. According to preferred embodiments, the intermediate layer includes a quantity of glass, carbon, aramid, metallic, or other fibers.

Further, the present invention relates to mantle compositions which improve initial velocity, or distance, while maintaining or at least substantially maintaining spin and playability characteristics and, conversely, compositions which improve spin and playability characteristics, while maintaining or at least substantially maintaining initial velocity and distance.

2. Description of Background and Related Art

Modern golf balls generally include multiple layers, i.e., such as two-piece and three-piece balls, which include wound balls and balata-covered balls. Two-piece solid balls typically include a rubber single-piece spherical core and a hard ionomer resin thermoplastic cover. These balls provide a relatively high initial speed and, therefore, they perform optimally for drives and for shots with the long woods. However, such golf balls typically have a hard feel at impact, because of the rigidity of their covers, and their performance for short shots, such as those employed with the short irons, is less than optimal because of a relatively low spin rate.

Wound balls, which typically include a solid or liquid core around which is wound a tensioned elastic thread, covered with an outer layer of either an ionomer resin or balata or an elastomer blend, e.g., have a softer feel at impact and they have a relatively high spin rate. Although distance is sacrificed somewhat, with respect to the aforementioned two-piece balls, wound balls thus provide an improved playability, particularly for experienced players.

United Kingdom Patent Application No. 2 278 609 discloses a multi-layer golf ball which is intended to offer certain advantages of previously known balls employing ionomeric resins, these advantages including improved distance, without sacrificing other advantages of wound or multi-layer balls, such as playability. To that end, U.K. Patent Application No. 2 278 609 discloses a ball having an inner cover layer employing a high acid ionomer or ionomer blend and an outer layer employing a soft, very low modulus ionomer/ionomer blend, or a non-ionomeric thermoplastic elastomer.

Commonly owned U.S. Pat. No. 5,253,871 discloses a multi-layer golf ball intended to have a considerable initial speed, close to that of the faster balls, such as the two-piece balls mentioned above, for favorable performance for drives and shots with the long woods, while also having a good feel, enabling good control or playability during short iron play, such as that for the wound balls. To this end, U.S. Pat. No. 5,253,871 discloses a ball having an elastoineric core, a thermoplastic cover, and an intermediate thermoplastic layer composed of at least 10% by weight of amide block copolyether. As mentioned in U.S. Pat. No. 5,253,871, the remarkable property of amide block copolyether is that, in contrast with ionomeric resins, the lower the hardness and modulus, the higher becomes the impact resilience. Like the ionomer resins, the amide block copolyethers are available in a wide range of hardness and flex modulii. U.S. Pat. No. 5,253,871 also discloses the optional addition of an ionomer to the ether block copolymer composition so as to limit the deformation of the ball at impact, while maintaining the hardness of the composition.

The intermediate layer, or mantle, of the ball of U.S. Pat. No. 5,253,871 is protected from cutting and peeling by the cover to provide the ball with a good durability. A relatively wide choice of materials is disclosed for the cover. Among the preferred materials are cited ionomers, amide block copolymers of the type used for the mantle but with greater hardness, ionomer and amide block copolymer compounds, thermoplastic polyurethanes, as well as combinations of these materials.

At the time of U.S. Pat. No. 5,253,871, the high acid ionomers were not publicly known. However, commonly owned U.S. application Ser. No. 08/915,081, filed on Aug. 20, 1997, the disclosure of which is incorporated by reference herein in its entirety, proposes a new composition for a cover that includes a soft amide block copolymer and a harder ionomer, such as a high acid ionomer. The cover composition has been found to contribute to the achievement of high values of spin rate for a better control, to improve the feel of the ball and, further, the cover composition has been found to contribute to the achievement of an increase in the initial speed and distance of the ball. The cover is disclosed as pertaining to all types of golf balls, including two-piece balls, three-piece solid balls, and wound balls.

Still further, commonly owned U.S. Provisional Application No. 60/070,497, filed on Jan. 5, 1998, the disclosure of which is also incorporated by reference herein in its entirety, discloses a composition for improving the durability of balls constructed according to U.S. application Ser. No. 08/915,081. Specifically, an agent for the compatibilization of the polyamide elastomer and the ionomer in the composition is described for reducing the incidence of cryogenic fractures and delamination at the interface between the ionomer and the polyamide elastomer.

Although golf balls employing various constructions and compositions are presently known, the initial speed and, therefore, the distance achieved with such golf balls tends to be limited if the spin rate and, thereby, the playability of such balls are not to be negatively affected. Similarly, spin rate and playability characteristics of golf balls tend to be limited if initial speed and distance are not to be negatively affected by other constructions and compositions.

SUMMARY OF THE INVENTION

An object of the present invention is to provide a golf ball that employs a structure and composition which at least substantially maintains the spin rate and playability characteristics of known golf balls, including those manufactured according to the aforementioned commonly owned patent and applications, while improving upon initial speed and distance.

Another object of the present invention is to provide a golf ball that employs a structure and composition which at least substantially maintains initial speed and distance of known golf balls, while improving upon spin rate and playability.

In this regard, while strides have been made recently to improve golf ball characteristics by means of specific cover compositions, additional strides can be made for such improvement, including meeting the aforementioned objects of the present invention, by means of intermediate layer compositions according to the present invention.

A further object of the present invention is improve upon the golf ball structure and composition of the above-mentioned commonly owned U.S. Pat. No. 5,253,871, particularly with regard to the composition of the mantle thereof. In a preferred embodiment, the composition of the mantle provides improved ball characteristics, while utilizing cover compositions disclosed in the aforementioned application Ser. Nos. 08/915,081 and 60/070,497.

To this end, whereas the mantle of the golf ball of U.S. Pat. No. 5,253,871 includes at least 10% by weight of a thermoplastic elastomer, such as an ether block copolymer and an optional addition of one or more ionomers for enhancing the hardness of the mantle, the present invention contemplates at least 10% by weight, preferably 10% to 99% by weight, of a soft, flexible resin, such as a thermoplastic elastomer and a hardness-enhancing material, including at least one non-ionomer fibrous hardness-enhancing material added to the soft, flexible resin.

In a preferred embodiment, the golf ball according to the invention includes a core, a cover, and at least one intermediate layer that includes a soft, flexible resin reinforced with at least one hardness-enhancing material, the hardness enhancing material including at least a quantity of non-continuous fiber elements located between the cover and the core.

The cover of the ball according to the invention can include a thermoplastic material and the core can include an elastomer, although the compositions of the core and cover are not considered to be limiting according to the invention.

The fiber elements that can be used in the intermediate layer can include fiber elements selected from the among the categories of glass fiber elements, carbon fiber elements, aramid fiber elements, and metallic fiber elements. The latter can include copper, high tensile steel, and stainless steel fiber elements.

In preferred embodiments, the quantity of fiber elements include about 1 weight percent to about 30 weight percent of the intermediate layer, preferably about 5 weight percent to about 20 weight percent of the intermediate layer, more preferably about 7 weight percent to about 15 weight percent of the intermediate layer, and even more preferably about 10 weight percent of the intermediate layer.

Further, the soft, flexible resin of the intermediate layer can include, according to a preferred embodiment, an elastomer, such as an amide block polyether. The elastomer can include a polyamide elastomer and/or a polyester elastomer. Pebax 2533 and Pebax 3533 are examples of elastomers which are found suitable for the invention.

Still further, the intermediate layer of a golf ball according to the invention can additionally include, as part of the hardness-enhancing material, at least one ionomer, such as at least one high acid ionomer.

In preferred embodiments of the golf ball intermediate layer of the invention, the fiber elements include glass fiber elements and/or carbon fiber elements.

As examples of the weight percents of the intermediate layer, the glass fiber elements can comprise about 10 weight percent, whereas the soft, flexible resin can comprise about 90 weight percent of the intermediate layer. Alternatively, according to another example of the invention, the glass fiber elements can comprise about 20 weight percent of the intermediate layer, with the soft, flexible resin comprising about 80 weight percent.

However, according to another example, the glass fiber elements can comprise about 10 weight percent of the intermediate layer, whereas about 85 weight percent of the intermediate layer is comprised of the soft flexible resin, with about 5 weight percent being comprised of at least one ionomer. In another example, the glass fiber elements can comprise about 10 weight percent of the intermediate layer, whereas about 80 weight percent of the intermediate layer is comprised of the soft flexible resin, with about 10 weight percent being comprised of at least one ionomer. Similar examples are contemplated with carbon fiber elements.

According to other characteristics of specific examples of golf balls according to the invention, the soft, flexible resin has a hardness of about 25 shore D or less, with the intermediate layer having a hardness of about 63.6 to about 73.5 shore C. According to other specific examples, the soft, flexible resin has a resin having a hardness of about 35 shore D or less, with the intermediate layer having a hardness of about 70.8 to about 75.1 shore C.

Preferably, according to the invention, the fiber elements are filamentary materials having a finite length at least 100 times their diameters, the diameters being typically about 0.10 to 0.13 millimeters. The fibers can be continuous or specific short lengths, no less than about 3.2 mm.

BRIEF DESCRIPTION OF THE DRAWING

Other advantages and characteristics of the invention will be better understood upon reading the description that follows and with reference to the annexed single FIGURE of drawing illustrating, by way of example, a golf ball according to the invention, including, in the illustrated example, a single mantle layer surrounding a core and lying beneath a cover.

DETAILED DESCRIPTION OF THE INVENTION

The present invention is directed to golf balls, including their structures and compositions. More particularly, the present invention relates to a multi-layer golf ball, an exemplary embodiment of which is shown schematically in the drawing FIGURE. The golf ball includes a core 1, an outer cover 3, and an intermediate layer 2. The intermediate layer or mantle 2 is shown to be immediately beneath the outer layer or cover 3. The invention encompasses, however, an intermediate layer that can be one of a plurality of layers beneath a cover layer.

The core 1 of the golf ball according to the invention can take any of several known forms. As an example, not to be taken as limiting, the composition of the core 1 can be that as described in U.S. Pat. No. 5,253,871, the disclosure of which is incorporated by reference for this purpose. Specifically, according to this example and as an acceptable composition encompassed by the present invention, the core comprises a thermoplastic or thermohardenable or vulcanizable elastomer, having an outer diameter in the range of approximately 1.34 inches to approximately 1.50 inches. The density of the core is comprised between approximately 1 and 1.3 g/cm$^3$. The shore D hardness of the core is preferably within the range of approximately 40 and 50, and the PGA compression is within the range of approximately 40 to approximately 90, preferably about 65–70.

The elastomer of the core 1, according to the aforementioned example, is a crosslinked diene elastomer of the polybutadiene cis-1,4 type containing a reaction product with zinc oxide and zinc diacrylate. The composition also contains a crosslinking agent such as dicumyl peroxide, for example.

The golf ball cover 3 preferably has a thickness of approximately 0.025 inches to approximately 0.110 inches, preferably approximately 0.04–0.06 inches, and more preferably approximately 0.05 inches, and a composition preferably according to one or more of the compositions disclosed in U.S. patent application Ser. Nos. 08/915,081 and 60/070,497, the disclosures of which are incorporated by reference for the purpose of disclosing such compositions.

The mantle 2 also has a thickness of approximately 0.013 inches to approximately 0.070 inches, preferably approximately 0.04–0.06 inches, and more preferably approximately 0.05 inches, and it is comprised of a soft, flexible resin, such as a thermoplastic elastomer, preferably having a weight percent within the range of about 10–99.

Resins

Examples of flexible resin include thermoplastic elastomers, thermoplastic elastomers modified with various functional or polar groups, thermoplastic rubber, thermoset rubber, thermoset elastomers, dynamically vulcanized thermoplastic elastomers, metalocene polymers or blends thereof, such as ionomer resins, polyetherester elastomers, polyetheramide elastomers, propylene-butadiene copolymers, modified copolymers of ethylene and propylene, styrenic copolymers including styrenic block copolymers and randomly distributed styrenic copolymers such as styrene-isobutylene copolymers, ethylene-vinyl acetate copolymers (EVA), 1,2-polybutadiene, and styrene-butadiene copolymers, dynamically vulcanized PP/EPDM, polyether or polyester thermoplastic urethanes as well as thermoset polyurethanes.

Among polyester elastomers that are contemplated are polyether ester block copolymers, polylactone ester block copolymers, aliphatic and aromatic dicarboxylic acid copolymerized polyesters, and the like. Polyether ester block copolymers are copolymers comprising polyester hard segments polymerized from a dicarboxylic acid and a low molecular weight diol and polyether soft segment polymerized from an alkylene glycol having 2 to 10 carbon atoms. The polylactone esterblock copolymers are copolymers with polylactone chains for the polyether as the soft segments in the above-mentioned polyether ester block copolymer structures. The aliphatic and aromatic dicarboxylic acid copolymerized polyesters are generally copolymers of an acid component selected from aromatic dicarboxylic acids such as terephthalic acid and isophthalic acid and aliphatic dicarboxylic acids having 2 to 10 carbon atoms, although blends of an aromatic polyester and an aliphatic polyester may be equally used here. Examples are Hytrel resins by DuPont and Skypel by SunKyuong Industries.

Among styrenic copolymers that are contemplated are ones manufactured by Shell Chemical Company under the tradenames of Kraton D rubber (styrene-butadiene-styrene and styrene-isoprene-styrene types), and Kraton G rubber (styrene-ethylene-butylene-styrene and styrene-ethylene-propylene-styrene types), or randomly distributed styrenic copolymers including paramethylstyrene-isobutylene (isobutene) copolymers developed by Exxon Chemical Company.

Among thermoplastic elastomers with functional or polar groups that are contemplated are thermoplastic elastomers with functional groups, such as carboxylic acid, maleic anhydride, glycidyl, norbonene, and hydroxyl group. Examples are maleic anhydride functionalized triblock copolymer consisting of polystyrene end blocks and poly (ethylene/butylene), such as Kraton FG 1901X by Shell Chemical Company; maleic anhydride modified ethylene-vinyl acetate copolymer, such as Fusabond by DuPont; ethylene-isobutyl acrylate-methacrylic acid terpolymer, such as Nucrel by DuPont; ethylene-ethyl acrylate-maleic anhydride terpolymer, Bondine AX 8390 and ethylene-ethyl acrylate-maleic anhydride terpolymer, Bondine AX8060 by Sumitomo Chemical Industries Co., Ltd.; bromonated styrene-isobutylene copolymers, such as Bromo XP-50 by Exxon; Lotader resins with glycidyl or maleic anhydride functional group by Elf Atochem Company, Paris, France; and the mixtures of the above resins.

Among dynamically vulcanized thermoplastic elastomers that are contemplated are dynamically vulcanized PP/EPDM under the tradename of Santoprene, Dytron, Vyram, Vistaflex, and Sarlink.

More specifically regarding the elastomer, as forming the soft, flexible resin component, the invention encompasses the use of one or more polyamide elastomers, and/or one or more polyester elastomers. Preferred polyamide and polyester elastomers of the invention include the soft polyamide and soft polyester elastomers. For the purpose of the present invention, it is to be understood that the soft elastomers, or soft resins, are preferably those having a hardness of about 35–40 shore D or less, preferably about 25–35 (according to ASTM D-2240).

Preferred polyamide elastomers of the invention include the block amide polyethers which result from the copolycondensation of polyamide blocks having reactive chain ends with polyether blocks having reactive chain ends, including:

1) polyamide blocks of diamine chain ends with polyoxyalkylene sequences of dicarboxylic chain ends;
2) polyamide blocks of dicarboxylic chain ends with polyoxyalkylene sequences of diamine chain ends obtained by cyanoethylation and hydrogenation of polyoxyalkylene alpha-omega dihydroxylated aliphatic sequences known as polyether diols; and
3) polyamide blocks of dicarboxylic chain ends with polyether diols, the products obtained, in this particular case, being polyetheresteramides.

The polyamide blocks of dicarboxylic chain ends come, for example, from the condensation of alpha-omega aminocarboxylic acids of lactam or of carboxylic diacids and diamines in the presence of a carboxylic diacid which limits the chain length. Preferably, the polyamide blocks are polyamide-12.

The molecular weight of the polyamide sequences is preferably between about 300 and 15,000, and more preferably between about 600 and 5,000. The molecular weight of the polyether sequences is preferably between about 100 and 6,000, and more preferably between about 200 and 3,000.

The amide block polyethers may also comprise randomly distributed units. These polymers may be prepared by the simultaneous reaction of polyether and precursor of polyamide blocks.

For example, the polyether diol may react with a lactam (or alpha-omega amino acid) and a diacid which limits the chain in the presence of water. There is obtained a polymer having mainly, polyether blocks, polyamide blocks of very variable length, but also the various reactive groups having reacted in a random manner and which are distributed statistically along the polymer chain.

Suitable amide block polyethers include those as disclosed in U.S. Pat. Nos. 4,331,786, 4,115,475, 4,195,015, 4,839,441, 4,864,014, 4,230,838, and 4,332,920. These patents are incorporated herein in their entireties, by reference thereto.

The polyether may be, for example, a polyethylene glycol (PEG), a polypropylene glycol (PPG), or a polytetramethylene glycol (PTMG), also designated as polytetrahydrofurane (PTHF).

The polyether blocks may be along the polymer chain in the form of diols or diamines. However, for reasons of simplification, they are designated PEG blocks, or PPG blocks, or also PTMG blocks.

It is also within the scope of the invention that the polyether block comprises different units such as units which derive from ethylene glycol, propylene glycol, or tetramethylene glycol.

Preferably, the amide block polyether comprises only one type of polyamide block and one type of polyether block. Mixing of two or more polymers with polyamide blocks and polyether blocks may also be used.

Preferably, the amide block polyether is such that it represents the major component in weight, i.e., that the amount of polyamide which is under the block configuration and that which is eventually distributed statistically in the chain represents 50 weight percent or more of the amide block polyether. Advantageously, the amount of polyamide and the amount of polyether is in a ratio (polyamide/polyether) of 1/1 to 3/1.

Also preferred as polyamide elastomers of the invention are the polyetheramide elastomers. Of these, suitable thermoplastic polyetheramides are chosen from among the family of Pebax, which are available from Elf-Atochem Company. Preferably, the choice can be made from among Pebax 2533, 3533, 4033 and 1205. Blends or combinations of Pebax 2533, 3533, 4033, and 1025 can also be prepared, as well. Pebax 2533 has a hardness of about 25 shore D (according to ASTM D-2240), a Flexural Modulus of 2.1 kpsi (according to ASTM D-790), and a Bayshore resilience of about 62% (according to ASTM D-2632). Pebax 3533 has a hardness of about 35 shore D (according to ASTM D-2240), a Flexural Modulus of 2.8 kpsi (according to ASTM D-790), and a Bayshore resilience of about 59% (according to ASTM D-2632). Pebax has the remarkable and probably unique property of increasing in resilience while decreasing in hardness. Pebax 4033 has a hardness of about 40 shore D (according to ASTM D-2240), a Flexural Modulus of 13 kpsi (according to ASTM D-790), and a Bayshore resilience of about 51%, (according to ASTM D-2632). Pebax 1205 also has a hardness of about 40 shore D (according to ASTM D-2240) and a Flexural Modulus of 1.13 kpsi (according to ASTM D-790). However, a small amount of Pebax 4033 or 1205 and other Pebax of lower hardness can be envisioned as long as the total hardness remains in the determined limits. It is noted that the shore hardness of Pebax varies little with the temperature between −40° C. and +80° C. The given values are determined at room temperature, between about 18 and 23° C.

Suitable polyester elastomers of the invention include polyetherester elastomers and polyesterester elastomers. Of these, the polyetherester elastomers are preferred. Commercially available polyetherester elastomers which may be used are SKYPEL G130D, G135D, and G140D from Sunkyong Industries, Seoul, Korea, and HYTREL G3078, G3548, and G4074 from DuPont.

Hardness-Enhancement of the Resin

In order to lessen the degree of deformation which the mantle experiences upon impact with the golf club head and to maintain velocity experienced upon impact with a golf club, such as the driver, a hardness-enhancing material is added to the soft, flexible resin or thermoplastic elastomer. The hardness-enhancing material, according to preferred embodiments, can include any of four broad categories of fibers or fiber segments, namely, glass, carbon, aramid, and metallic. However, other materials, including other fibers, are also contemplated. For example, combinations of fibers and one or more ionomers, particularly one or more high acid ionomers.

Fibers that are contemplated to be usable with the invention include those described in *Handbook of Composites*, Vol. 4, "Fabrication of Composites", by A. Kelly and F. T. Mileiko, published by Elsevier Science Publishers B.V., Amsterdam, Netherlands, 1983.

Materials suitable for use as the non-ionomer hardness-enhancing materials which are appropriate for the mantle of the golf ball according to the invention include glass fibers, such as E fibers, Cem-Fil filament fibers, and 204 filament strand fibers; carbon fibers such as graphite fibers, high modulus carbon fibers, and high strength carbon fibers; asbestos fibers, such as chrysotile and crocidolite; cellulose fibers; aramid fibers, such as Kevlar, including types PRD 29 and PRD 49; metallic fibers, such as copper, high tensile steel, and stainless steel. In addition, single crystal fibers, potassium titanate fibers, calcium sulphate fibers, and fibers or filaments of one or more linear synthetic polymers such as Terylene, Dacron, Perlon, Orion, Nylon, including Nylon type 242, are contemplated. Polypropylene fibers, including monofilament and fibrillated fibers are also contemplated.

For the purpose of this invention, the term "fiber" is a general term for which the definition given in *Engineered Materials Handbook*, Vol. 2, "Engineering Plastics", published by A.S.M. International, Metals Park, Ohio, USA, is relied upon to refer to filamentary materials with a finite length that is at least 100 times its diameter, which is typically 0.10 to 0.13 mm (0.004 to 0.005 in.). Fibers can be continuous or specific short lengths (discontinuous), normally no less than 3.2 mm (⅛ in.). Although fibers according to this definition are preferred, fiber segments, i.e., parts of fibers having lengths less than the aforementioned are also considered to be encompassed by the invention. Thus, the terms "fibers" and "fiber segments" are used herein. In the claims appearing at the end of this disclosure in particular, the expression "fibers or fiber segments" and "fiber elements" are used to encompass both fibers and fiber segments.

It is known that the addition of glass, carbon, inorganic, or high-tensile organic fibers to a polymer will bring a dramatic effect on its properties. These properties can vary from being similar to those of the base polymer, at low loadings, to approaching those of the reinforcement, at high loadings. The form of the fibers or fiber segments is very important and has a significant effect on final physical properties of the product, composite material. The fiber or fiber segment form can be very short, as with milled glass fibers, which would be less than 0.5 mm (0.02 in.) in length; short chopped fibers to about 2 mm (0.08 in.); and long chopped fibers to 10 to 50 mm (0.4 to 2 in.). The use of inorganic fibers or various inorganic fibers or the various forms of carbon and organic fibers can provide better physical properties. Generally, adding reinforcement increases the hardness of the plastic part. The greater the fiber content, the greater the flexural modulus. This effect is true no matter what form of fiber element is used. The advantage of long fiber length is that with higher fiber loadings, some physical properties, such as tensile and flexural strength, become more related to those of the reinforcement. The fiber elements used for the invention can be either a surface-treated fiber or a non-treated fiber. Relatively high density fiber elements, such as metallic fiber elements, particularly stainless steel fiber elements, e.g., possess the benefit that weight can be shifted to the outside of the golf ball to increase the moment of inertia effect.

According to a preferred embodiment of the invention, glass fiber elements are used as the hardness-enhancing material added to the thermoplastic elastomer or other soft, flexible resin. Further, as with the mantle of U.S. Pat. No. 5,253,871, the elastomer used in this particular preferred embodiment is an aiide block copolyether known commercially as Pebax of Elf-Atochem.

Glass fiber elements, as the hardness-enhancing material, have been found to be less expensive than the known proprietary ionomers. Further, and more importantly, the performance of the golf ball with such mantle layer, i.e., in which an equal weight percentage (wt %) of glass fiber elements is used in place of ionomer, has been found to be improved. More specifically, it has been found that the coefficient of restitution (COR) and initial speed of the ball are greater, while the spin rate is maintained or at least substantially maintained.

In certain examples, it has been found that preferred weight percents of glass fiber elements include 10 wt % and 20 wt %. For carbon fiber elements, 10 wt % and 20 wt % have also been found to be preferable. For other fiber elements, other amounts have been found to be preferable. For example, for metallic fiber elements, such as stainless steel fiber elements, a wt % of about 10 or less has been found to be preferable. In general, according to the invention, for all fiber types, the amount of fiber elements to be included in the mantle composition is contemplated to be in a range of about 1 wt % to about 30 wt %, preferably about 5 wt % to about 20 wt %, more preferably about 7 wt % to about 15 wt %, and even more preferably, about 10 wt %.

According to a preferred embodiment of the invention, glass fiber elements are used as the hardness-enhancing material added to the thermoplastic elastomer or other soft, flexible resin. Further, as with the mantle of U.S. Pat. No. 5,253,871, the elastomer used in this preferred embodiment is an amide block copolyether known commercially as Pebax of Elf-Atochem Company, Paris, France. More specifically, Pebax 3533 is used in this preferred embodiment.

The weight percent of glass fiber elements should be preferably within the range of from about 10% to about 20%, or other range as mentioned above. As the amount of glass fiber is increased, the mantle tends to be become brittle and begins to risk cracking.

Processing

The fiber elements can be blended with the elastomer, or other soft, flexible resin, by any dry mixer or dry mixing, Banbury type mixer, two-roll mill or extruder, prior to being used for the mantle application. Additional materials may also be added to the polymer/fiber composite, such as dyes, antioxidants, stabilizers, processing aids, plasticizers, and other reinforcing materials, such as organic or inorganic fillers.

A variety of conventional molding methods can be used, such as compression molding, retractable pin injection molding, fixed pin injection molding, thermoforming, transfer molding, or a combination of these methods.

EXAMPLES—TABLE 1

In Table 1, a first set of examples of golf balls constructed according to the present invention are identified.

Examples of golf balls according to the invention are identified in Table 1 as GF-10, GF-20, CF-10, and CF-20. Three comparative examples, or controls, are identified as Peb-100, Peb-90, and Peb-80.

Cover Composition

In each of the examples, for both the invention (GF-10, GF-20, CF-10, CF-20) and for comparative purposes (Peb-100, Peb-90, Peb-80), an identical cover composition is used. This cover composition is disclosed in the aforementioned U.S. application Ser. No. 60/070,497 and it is utilized for the examples both because of its superior performance and for the purpose of facilitating the comparison of the various examples, to be described below.

The scope of the invention, however, is intended to encompass cover compositions other than the specific composition described below and those disclosed in the aforementioned applications.

The specific cover composition used in the examples identified in Table 1, is the following:

Pebax 2533: 40 weight percent

Surlyn 8140: 30 weight percent

Surlyn 9120: 25 weight percent

Lotader AX8900: 5 weight percent

As mentioned above Pebax 2533 identifies an amide block polyether having a hardness of 25 shore D (according to ASTM D-2240), a flexural modulus of 2.1 kpsi (according to ASTM D-790), and a Bayshore resilience of about 62% (according to ASTM D-2632).

Surlyn 8140 identifies a high acid ionomer resin sold by E.I. DuPont de Nemours & Company, and having the following characteristics and properties:

Cation type: Na

Melt flow Index: 2.6 g/10 min (ASTM D-1238)

Specific gravity: 0.95 (ASTM D-792)

Tensile strength: 34.5 MPa (ASTM D638)

Yield strength: 19.3 MPa (ASTM D638)

Elongation: 340% (ASTM D638)

Hardness: 70 shore D (ASTM D-2240)

Flexural Modulus: 545 MPa (ASTM D-790)

Bayshore resilience: 62% (ASTM D-2632)

Surlyn 9120 identifies a high acid ionomer resin sold by E.I. DuPont de Nemours & Company, and having the following characteristics and properties:

Cation type: Zn

Melt flow Index: 1.3 g/10 min (ASTM D-1238)

Specific gravity: 0.97 (ASTM D-792)

Tensile strength: 3.8 kpsi (ASTM D638)

Yield strength: 2.4 kpsi (ASTM D638)

Elongation: 280% (ASTM D638)

Hardness: 69 shore D (ASTM D-2240)

Flexural Modulus: (64 kpsi (ASTM D-790)

Bayshore resilience: 64% (ASTM D-2632)

Lotader AX8900 identifies a terpolymer of ethylene, n-butyl acrylate, and glycidyl methacrylate produced by Elf-Atochem Co.

Core Composition

The core composition used in the examples for the invention (GF-10, GF-20, CF-10, CF-20) is maintained the same for comparison purposes (Peb-100, Peb-90, Peb-80), as can be seen in Table 1. The diameter is 1.48 inches, it has a PGA compression of 70, and it includes polybutadiene rubber with a peroxide curing system. The core also includes zinc acrylate with a co-crosslinking agent. Zinc oxide is used as a filler.

Mantle Composition

The mantle compositions vary among the examples, as shown in Table 1 With regard to the elastomer component: for examples GF-10, CF-10, and Peb-90, the Pebax component represents 90 wt % of the mantle; for examples GF-20, CF-20, and Peb-80, the Pebax component represents 80 wt % of the mantle; and for example Peb-100, the Pebax component represents the entirety of the mantle, 100 wt %.

For the glass fibers used in the examples of Table 1, glass fibers manufactured by Owens Corning were used. More specifically, Owens Corning fiber number 144A was used. This fiber type has a nominal chop length of 4.0 mm (5/32 inches). By nominal, for the 144A fiber, it is meant that not more than 1.99% of the fiber strands by weight in a container are greater than the specified length as determined by Owens-Corning Test Method D-12E (Percent Long Fibers). Further, fiber 144A has a maximum moisture content of 0.05%; strand solids are nominally 0.90%, with a minimum of 0.70% and a maximum of 1.10%; and a strand integrity of 30.0% maximum.

For the carbon fibers used in the examples of Table 1, carbon fibers manufactured by AKZO NOBEL, Rockwood, Tenn., USA, were used. More specifically, chopped Fortafil 3(C) carbon fiber was used. This fiber is a high strength, standard modulus fiber supplied as a 50,000 filament continuous tow, intended for use, according to the manufacturer, in processes such as filament winding, pultrusion, or prepregging, which require the efficient use of large quantities of carbon fiber. The fiber is surface treated to improve the fiber to resin interfacial bond strength. Applications for this fiber include products for the general industrial, sporting goods, and aerospace markets.

Still more specifically, the Fortafil 3(C) carbon fiber, used in the examples, possesses the following characteristics:

| Typical Properties of Fortafil 3(C) Carbon Fibers: | | |
|---|---|---|
| Tensile Strength* | 550 ksi | 3800 MPa |
| Tensile Modulus* | 33 Msi | 227 GPa |
| Ultimate Elongation* | 1.7 % | 1.7 % |
| Density | 0.065 lb/in$^3$ | 1.8 g/cm$^3$ |
| Cross-Sectional Area | $6.4 \times 10^{-8}$in$^2$ | $4.1 \times 10^{-5}$mm$^2$ |
| Filament Shape | Round | |
| Filament Diameter | $0.28 \times 10^{-3}$ | 7.0 $\mu$ |
| Denier/Filament (dpf) | | 0.70 |
| Specific Heat @ R.T. | | 0.22 cal/g/°C. |
| Axial Thermal Conductivity | | 0.20 W/cm-°C. |
| Axial Thermal Expansion | | $-0.1 \times 10^4$/°C. |
| Electrical Resistivity | | 1679 $\mu\Omega$-cm |
| pH (distilled water) | | Neutral |

| Elemental Analysis of Fortafil 3(C) Carbon Fibers: |
|---|
| Carbon 95.0% |
| Nitrogen 3.6% |
| Hydrogen 0.4% |
| Oxygen 0.4% |
| Ash 0.6% |

| Typical Tow Properties of Fortafil 3(C) Carbon Fibers: | | |
|---|---|---|
| Filaments per tow | 50,000 | |
| Yield | 400 ft/lb | 0.27 m/g |

-continued

| | | |
|---|---|---|
| Cross-Sectional Area | $3.2 \times 10^{-3}$in$^2$ | 2.1 mm$^2$ |
| Denier (g/9000 m) | | 35,000 |
| Twist | | None |

| Typical Panel Properties of Fortafil 3(C) Carbon Fibers: (Unidirectional, 60 volume % fiber loading in 250° F. epoxy) | | |
|---|---|---|
| Tensile Strength | 265 ksi | 1820 MPa |
| Tensile Modulus | 19 Msi | 130 GPa |
| Flexural Strength | 300 ksi | 2070 MPa |
| Flexural Modulus | 18 Msi | 125 GPa |
| Shear Strength | 15 ksi | 100 MPa |

*Impregnated strand test

The data appearing in Table 1 represent trials conducted on a minimum of 12 golf balls, to as many as 24 golf balls, for each of the examples, i.e., golf balls constructed according to each of the examples GF-10, GF-20, CF-10, CF-20, Peb-100, Peb-90, and Peb-80. The values for the coefficient of restitution were obtained by using an air cannon, according to conventional techniques. The outbound speed of the tested golf balls was set at 125 feet per second, to at least generally correspond to the speed of a driver. For obtaining other performance data, all tested balls were struck with a Golf Labs, Inc. swing robot.

For the purpose of analyzing the performance data in Table 1, it would be relevant to compare the control ball Peb-80 with examples GF-20 and CF-20, since all three balls have the same amount of Pebax, viz., 80 wt %. Similarly, it would be relevant to compare the control ball Peb-90 with examples GF-10 and CF-10, since all three balls also have the same amount of Pebax, viz., 90 wt %. The control ball Peb-100, of course, provides relevant comparative purposes inasmuch as the mantle thereof is composed of 100% Pebax.

The hardener component also varies, as shown in Table 1. For example in GF-10, 10 wt % of glass fibers is used. Example GF-20 includes 20 wt % of glass fibers. Example CF-10 includes 10 wt % carbon fibers. Example CF-20 includes 20 wt % carbon fibers. Example Peb-100 includes no hardener component. Example Peb-90 includes 5 wt % Surlyn 8140 and 5 wt % Surlyn 9120. Example Peb-80 includes 10 wt % Surlyn 8140 and 10 wt % Surlyn 9120.

TABLE 1

| | Glass and Carbon Fiber Mantles | | | | | | |
|---|---|---|---|---|---|---|---|
| | GF-10 | GF-20 | CF-10 | CF-20 | Peb-100 | Peb-90 | Peb-80 |
| Core Size (inches) | 1.48 | 1.48 | 1.48 | 1.48 | 1.48 | 1.48 | 1.48 |
| Core Compression (PGA) | 70 | 70 | 70 | 70 | 70 | 70 | 70 |
| Mantle Size (inches) | 1.58 | 1.58 | 1.58 | 1.58 | 1.58 | 1.58 | 1.58 |
| Mantle Material | 90% 2533<br>10% glass fibers | 80% 2533<br>20% glass fibers | 90% 2533<br>10% carbon fibers | 80% 2533<br>20% carbon fibers | 100% 2533 | 90% 2533<br>5% 8140<br>5% 9120 | 80% 2533<br>10% 8140<br>10% 9120 |
| Cover Blend | 40% 2533<br>30% 8140<br>25% 9120<br>5% Lotader | 40% 2533<br>30% 8140<br>25% 9120<br>5% Lotader | 40% 2533<br>30% 8140<br>25% 9120<br>5% Lotader | 40% 2533<br>30% 8140<br>25% 9120<br>5% Lotader | 40% 2533<br>30% 8140<br>25% 9120<br>5% Lotader | 40% 2533<br>30% 8140<br>25% 9120<br>5% Lotader | 40% 2533<br>30% 8140<br>25% 9120<br>5% Lotader |

TABLE 1-continued

| | Glass and Carbon Fiber Mantles | | | | | | |
|---|---|---|---|---|---|---|---|
| | GF-10 | GF-20 | CF-10 | CF-20 | Peb-100 | Peb-90 | Peb-80 |
| Mantle Hardness (Shore C) | 63.6 | 69.4 | 69 | 73.5 | 52.3 | 58.6 | 61.3 |
| Cover Hardness (Shore D) | 50 | 50 | 49 | 50 | 50 | 50 | 51 |
| Compression (PGA) | 67 | 69 | 69 | 71 | 60 | 64 | 67 |
| Weight (ounces) | 1.623 | 1.639 | 1.62 | 1.626 | 1.63 | 1.626 | 1.622 |
| Mantle Coeff. of Restitution (COR) | 0.778 | 0.774 | 0.770 | 0.775 | 0.771 | 0.772 | 0.773 |
| Ball COR | 0.781 | 0.779 | 0.782 | 0.778 | 0.774 | 0.777 | 0.780 |
| Driver Speed (mph) | 155.5 | 155.2 | 155.5 | 155.3 | 154.2 | 154.9 | 155.3 |
| Driver Spin Rate (rpm) | 3395 | 3460 | 3405 | 3335 | 4000 | 3700 | 3400 |
| Driver Launch Angle (degrees) | 7.6 | 7.2 | 7.7 | 7.7 | 7.6 | 7.7 | 7.8 |
| 8-Iron Speed (mph) | 108.3 | 108 | 108 | 107.7 | 106.9 | 107.4 | 108 |
| 8-Iron Spin Rate (mph) | 8830 | 8760 | 8700 | 8540 | 9400 | 9000 | 8750 |
| 8-Iron Launch Angle (degrees) | 19.2 | 19 | 19.3 | 19.4 | 19 | 19.2 | 19.3 |

From the results of various tests, as represented in Table 1, certain observations can be made.

First, it can be observed that the mantle hardness values are greater for the examples of the invention compared to the comparative examples or controls, when the respective examples having an equivalent wt % of hardness-enhancing material are examined, i.e., fibers compared to ionomer(s). For example, the GF-10 ball has a mantle hardness (shore C) of 63.6, compared to a mantle hardness of the Peb-90 control ball of 58.6. Similarly, the GF-20 ball has a mantle hardness (shore C) of 69.4, compared to a mantle hardness of the Peb-80 control ball of 61.3.

In addition, the resulting coefficients of restitution are greater for a certain example ball of the invention, compared to that of the control that utilized ionomer resins for the hardening component. For example, with regard to the example GF-10, although the same wt % of Pebax 2533 was used as with the control Peb-90, for the soft, flexible resin, in order to maintain a certain playability or spin rate, glass fibers were added so as to bring the launch velocity back to a predetermined or recognized level, at least representative of the control. However, although a relatively small wt % of glass fibers was actually utilized, i.e., 10 wt %, it can be seen that the coefficient of restitution (COR) increased from 0.772, for the control (Peb-90) to 0.778, for the example of the invention (GF-10). Consequently, the launch velocity also increased, from 154.9 mph to 155.5 mph, for the driver, and from 107.4 mph to 108.3 mph for the 8-iron.

Another interesting result can be noted in a comparison of the example GF-10 with the control Peb-80. Even though the example GF-10 includes a greater wt % of Pebax, i.e., 90 compared to 80 for the control Peb-80, the mantle hardness proves to be greater. As a result, not only is the spin rate improved for the example, at least when struck with an 8-iron, but the launch velocity is at least maintained or is slightly improved.

In general, it can be observed that one is able to increase the wt % of the soft resin or Pebax, when glass fibers are added as the hardening material, with the objective of improving the playability of the ball, while not degrading the launch velocity or distance achieved by the ball.

The following chart summarizes certain data, Young's Modulus in particular, for three examples of golf balls having a mantle layer with a mixture of glass fibers and elastomer (Pebax 2533), and for three examples of golf balls having a mantle layer with a mixture of Surlyn (AD 8552) and elastomer (Pebax 3533).

| MATERIAL | GF-5 | GF-10 | GF-20 | S-5 | S-10 | S-20 |
|---|---|---|---|---|---|---|
| Pebax 2533 (wt %) | 95 | 90 | 80 | | | |
| Pebax 3533 (wt %) | | | | 95 | 90 | 80 |
| Glass fibers (wt %) | 5 | 10 | 20 | | | |
| AD 8552 (wt %) | | | | 5 | 10 | 20 |
| Young's Modulus (ksi) | 2.004 | 3.009 | 5.375 | 1.856 | 1.960 | 2.416 |

The chart above shows that, for a given weight percent of hardness-enhancing material (i.e., 5%, 10%, or 20%), Pebax 2533 with glass fibers exhibits a higher Young's Modulus than Pebax 3533 with a high modulus Surlyn.

The flex modulus is a direct indication of the coefficient of restitution (COR). Typically, the higher flex modulus ionomers (Surlyns) are very fast with respect to COR, while the low modulus ionomers (VLMI Surlyns) are considerably slower. Therefore, glass fibers produce blends with higher flex modulus, and the data above helps to explain why the COR's have increased in Table 1.

EXAMPLES—TABLE 2

In Table 2, a second set of examples of golf balls constructed according to the present invention are identified.

Examples of golf balls according to the invention are identified in Table 2 as GF10-35, GF10-85, and GF10-90. A comparative example, or control, is identified in the right-most column of the table.

Cover Composition

In each of the examples, for both the invention (GF10-35, GF10-85, GF10-90) and for the control, an identical cover composition is used. As mentioned previously, the invention encompasses compositions other than the specific composition described below and those disclosed in the aforementioned applications.

The specific cover composition used in the examples identified in Table 2, is the following:

Pebax 2533: 40 weight percent

Surlyn AD8552: 55 weight percent

Lotader AX8900: 5 weight percent

Pebax 2533 and Lotader AX8900 are described above with respect to the examples in Table 1.

Surlyn AD8552 identifies a high acid ionomer sold by E.I. DuPont de Nemours & Company, and having the following characteristics and properties:

Cation type: Mg

Melt flow Index: 1.3 g/10 min (ASTM D-1238)

Specific gravity: 0.95 (ASTM D-792)

Tensile strength: 5.2 kpsi (ASTM D638)

Yield strength: 2.9 kpsi (ASTM D638)

Elongation: 270% (ASTM D638)

Hardness: 67 shore D (ASTM D-2240)

Flexural Modulus: 75 kpsi (ASTM D-790)

Bayshore resilience: 65% (ASTM D-2632)

Core Composition

The core composition used in the examples for the invention in Table 2 is the same as that of the examples of Table 1.

Mantle Composition

For the mantle in the examples of Table 2, Pebax 3533 is used rather than Pebax 2533. As mentioned above, Pebax 3533 identifies an amide block polyether having a hardness of 35 shore D (according to ASTM D-2240), a Flexural Modulus of 2.8 kpsi (according to ASTM D-790), and a Bayshore resilience of about 59% (according to ASTM D-2632).

Among the examples shown in Table 2 the mantle compositions vary. With regard to the elastomer component: for example GF10-35, the Pebax 3533 component represents 90 wt % of the mantle; for example GF10-85, the Pebax 3533 component represents 85 wt % of the mantle; for example GF10-90, the Pebax 3533 component represents 80 wt % of the mantle; and for the control, the Pebax 3533 component represents 70% of the mantle.

The hardener component also varies, as shown in Table 2. For the example GF10-35, the hardener component is composed of 10 wt % of glass fibers. For the example GF10-85, the hardener component is composed of 10 wt % of glass fibers and 5% Surlyn 8140. For the example GF10-90, the hardener component is composed of 10% glass fibers and 10% Surlyn 8140. For the control, the hardener component is composed of 15% Surlyn 8140 and 15% Surlyn 9120. In the examples of Table 2, therefore, unlike those of Table 1, two examples according to the invention employ certain amounts of an ionomer in addition to fibers. Also contemplated according to the invention is an example similar to that of GF10-90, except that the 10% Surlyn 8140 component is replaced by a 5% Surlyn 8140 component and a 5% Surlyn 9120 component.

The glass fibers used for the examples in Table 2 are the same as those that were used for the examples in Table 1 and which are described above.

TABLE 2

| | Glass Fiber Mantles | | | |
|---|---|---|---|---|
| | GF10-35 | GF10-85 | GF10-90 | CON-TROL |
| Core Size (inches) | 1.48 | 148 | 148 | 148 |
| Core Compression (PGA) | 70 | 70 | 70 | 70 |
| Mantle Size (inches) | 1.58 | 1.58 | 1.58 | 1.58 |
| Mantle Material | 10% glass fibers 90% Pebax 3533 | 10% glass fibers 85% Pebax 3533 5% 8140 | 10% glass fibers 80% Pebax 3533 10% 8140 | 70% 3533 15% 8140 15% 9120 |
| Cover Blend | 40% 2533 55% AD8552 5% | 40% 2533 55% AD8552 5% | 40% 2533 55% AD8552 5% | 40% 2533 55% AD8552 5% |

TABLE 2-continued

| | Glass Fiber Mantles | | | |
|---|---|---|---|---|
| | GF10-35 | GF10-85 | GF10-90 | CON-TROL |
| | Lotader | Lotader | Lotader | Lotader |
| Mantle Hardness (Shore C) | 70.8 | 72.3 | 75.1 | 64.1 |
| Cover Hardness (Shore D) | 45 | 45 | 45 | 47 |
| Compression (PGA) | 65 | 64 | 66 | 69 |
| Weight (ounces) | 1.628 | 1.627 | 1.629 | 1.62 |
| Mantle Coeff. of Restitution (COR) | 0.777 | 0.776 | 0.774 | 0.775 |
| Ball COR | 0.778 | 0.777 | 0.774 | 0.776 |
| Driver Speed (mph) | 154.1 | 154.8 | 154.2 | 154.2 |
| Driver Spin Rate (rpm) | 3590 | 3600 | 3510 | 3400 |
| Driver Launch Angle (degrees) | 7.8 | 8 | 7.8 | 7.9 |
| 8-Iron Speed (mph) | 111.1 | 110.9 | 110.8 | 110.2 |
| 8-Iron Spin Rate (mph) | 9000 | 9030 | 8850 | 8500 |
| 8-Iron Launch Angle (degrees) | 18.7 | 18.6 | 18.6 | 19.1 |

From the results of various tests, as represented in Table 2, certain observations can be made.

As with the performance results shown in Table 1, the examples according to the invention show that the use of glass fibers enable an increase in the amount of Pebax used, i.e., a relatively smaller wt % of fibers are used for the purpose of maintaining initial or launch speed, so that a greater wt % of Pebax can be used so as to increase the spin rate and playability of the ball. In this regard, it can be observed, e.g., that the spin rate of the GF10-35 example is significantly increased to 9000 rpm for the 8-iron, while the initial speed is maintained, actually slightly increased, at 111.1 mph.

Although the preferred embodiments have been described in detail hereinabove, certain modifications may be envisioned by one of ordinary skill in the art, without departing from the scope of the invention that is encompassed by the claims which follow.

What is claimed is:

1. A golf ball comprising:

a core;

a cover; and at least one intermediate layer comprising a soft, flexible resin reinforced with at least one hardness-enhancing material, said hardness enhancing material including at least a quantity of non-continuous fiber elements located between the cover and the core.

2. A golf ball according to claim 1, wherein:

the fiber elements comprise a member selected from the group consisting of glass fiber elements, carbon fiber elements, aramid fiber elements, and metallic fiber elements.

3. A golf ball according to claim 1, wherein:

the quantity of fiber elements comprise about 1 weight percent to about 30 weight percent of the intermediate layer.

4. A golf ball according to claim 1, wherein:

the quantity of fiber elements comprise about 5 weight percent to about 20 weight percent of the intermediate layer.

5. A golf ball according to claim 1, wherein:

the quantity of fiber elements comprise about 7 weight percent to about 15 weight percent of the intermediate layer.

6. A golf ball according to claim 1, wherein:

the soft, flexible resin comprises an elastomer.

7. A golf ball according to claim 6, wherein:

the elastomer comprises an amide block polyether.

8. A golf ball according to claim 6, wherein:

the elastomer comprises at least one member selected from the group consisting of polyamide elastomers and polyester elastomers.

9. A golf ball according to claim 6, wherein:

the elastomer comprises a member selected from the group consisting of Pebax 2533 and Pebax 3533.

10. A golf ball according to claim 1, wherein:

the at least one hardness-enhancing material further includes at least one ionomer.

11. A golf ball according to claim 10, wherein:

the at least one ionomer includes at least one high acid ionomer.

12. A golf ball according to claim 1, wherein:

the fiber elements include glass fiber elements.

13. A golf ball according to claim 12, wherein:

the glass fiber elements comprise about 10 weight percent of the intermediate layer.

14. A golf ball according to claim 13, wherein:

the soft, flexible resin comprises about 90 weight percent of the intermediate layer.

15. A golf ball according to claim 13, wherein:

the soft, flexible resin comprises about 85 weight percent of the intermediate layer; and the at least one hardness-enhancing material further includes at least one ionomer comprising about 5 weight percent of the intermediate layer.

16. A golf ball according to claim 13, wherein:

the soft, flexible resin comprises about 80 weight percent of the intermediate layer; and the at least one hardness-enhancing material further includes at least one ionomer comprising about 10 weight percent of the intermediate layer.

17. A golf ball according to claim 12, wherein:

the glass fiber elements comprise about 20 weight percent of the intermediate layer.

18. A golf ball according to claim 1, wherein:

the fiber elements include carbon fiber elements.

19. A golf ball according to claim 18, wherein:

the carbon fiber elements comprise about 10 weight percent of the intermediate layer.

20. A golf ball according to claim 19, wherein:

the soft, flexible resin comprises about 90 weight percent of the intermediate layer.

21. A golf ball according to claim 18, wherein:

the carbon fiber elements comprise about 20 weight percent of the intermediate layer.

22. A golf ball according to claim 21, wherein:

the soft, flexible resin comprises about 80 weight percent of the intermediate layer.

23. A golf ball according to claim 1, wherein:

the fiber elements include metallic fiber elements.

24. A golf ball according to claim 23, wherein:

the metallic fiber elements comprise copper fiber elements.

25. A golf ball according to claim 23, wherein:

the metallic fiber elements comprise high tensile steel fiber elements.

26. A golf ball according to claim 23, wherein:

the metallic fiber elements comprise stainless steel fiber elements.

27. A golf ball according to claim 26, wherein:

the stainless steel fiber elements comprise about 10 weight percent or less of the intermediate layer.

28. A golf ball according to claim 23, wherein:

the metallic fiber elements comprise about 10 weight percent or less of the intermediate layer.

29. A golf ball according to claim 1, wherein:

the soft, flexible resin comprises a resin having a hardness of about 25 shore D or less; and the intermediate layer has a hardness of about 63.6 to about 73.5 shore C.

30. A golf ball according to claim 1, wherein:

the soft, flexible resin comprises a resin having a hardness of about 35 shore D or less; and the intermediate layer has a hardness of about 70.8 to about 75.1 shore C.

31. A golf ball according to claim 1, wherein:

the core comprises an elastomer.

32. A golf ball according to claim 1, wherein:

the cover comprises a thermoplastic material.

33. A golf ball according to claim 1, wherein:

the fiber elements consist essentially of fibers, each having a length at least 100 times its diameter.

34. A golf ball according to claim 33, wherein:

the lengths of the fibers are at least approximately ⅛ inch.

* * * * *

UNITED STATES PATENT AND TRADEMARK OFFICE

CERTIFICATE OF CORRECTION

PATENT NO. : 6,012,991

DATED : January 11, 2000

INVENTOR(S) : Hyun Kim et al.

It is certified that error appears in the above-identified patent and that said Letters Patent is hereby corrected as shown below:

On the title page, item [56], References Cited, under "FOREIGN PATENT DOCUMENTS," the following document should be inserted:

-- WO 99/36130 7/199 WIPO --.

Signed and Sealed this

First Day of August, 2000

*Attest:*

Q. TODD DICKINSON

*Attesting Officer*

*Director of Patents and Trademarks*